US007841879B2

(12) United States Patent
Nakamura

(10) Patent No.: US 7,841,879 B2
(45) Date of Patent: Nov. 30, 2010

(54) FLOATING-TYPE CONNECTOR

(75) Inventor: Keisuke Nakamura, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 69 days.

(21) Appl. No.: 12/274,099

(22) Filed: Nov. 19, 2008

(65) Prior Publication Data

US 2009/0137140 A1 May 28, 2009

(30) Foreign Application Priority Data

Nov. 22, 2007 (JP) ..... 2007-303732

(51) Int. Cl.
*H01R 13/64* (2006.01)

(52) U.S. Cl. ..... 439/248

(58) Field of Classification Search ..... 439/246–249
See application file for complete search history.

(56) References Cited

U.S. PATENT DOCUMENTS

| | | | | |
|---|---|---|---|---|
| 6,039,590 | A * | 3/2000 | Kunishi | 439/247 |
| 7,056,136 | B2 | 6/2006 | Iwasaki | |
| 7,204,707 | B2 * | 4/2007 | Kawase et al. | 439/247 |
| 7,544,098 | B2 * | 6/2009 | Nakamura | 439/630 |
| 2004/0253863 | A1 | 12/2004 | Iwasaki | |
| 2006/0019520 | A1 * | 1/2006 | Kawase et al. | 439/247 |
| 2009/0004901 | A1 * | 1/2009 | Nakamura | 439/247 |
| 2009/0137140 | A1 * | 5/2009 | Nakamura | 439/262 |

FOREIGN PATENT DOCUMENTS

| | | | |
|---|---|---|---|
| JP | 10-241807 | A | 9/1998 |
| JP | 10-326654 | A | 12/1998 |
| JP | 11-265757 | A | 9/1999 |
| JP | 2000-260527 | A | 9/2000 |
| JP | 2002-95135 | A | 3/2002 |
| JP | 2005-5053 | A | 1/2005 |
| JP | 2006-59788 | A | 3/2006 |

OTHER PUBLICATIONS

Japanese Office Action dated Sep. 15, 2009 (3 pages), and English translation thereof (2 pages), issued in counterpart Japanese Application Serial No. 2007-303732.

* cited by examiner

*Primary Examiner*—James Harvey
(74) *Attorney, Agent, or Firm*—Holtz, Holtz, Goodman & Chick, PC

(57) ABSTRACT

A connector adapted to be connected to and disconnected from a mating object in a connecting/disconnecting direction, includes an alignment member, a rear housing coupled to the alignment member, and a front housing that is adapted to receive the mating object and is movable with respect to the alignment member and the rear housing. A contact is held by the front housing and the rear housing. The alignment member and the rear housing include a stopper mechanism which three-dimensionally defines a movable range of the front housing.

9 Claims, 6 Drawing Sheets

FLOATING-TYPE CONNECTOR

This application is based upon and claims the benefit of priority from Japanese patent application JP 2007-303732, filed on Nov. 22, 2007, the disclosure of which is incorporated herein in its entirety by reference.

TECHNICAL FIELD

This invention relates to a connector which is so-called a floating-type.

BACKGROUND ART

A connector of the type is disclosed in Japanese Unexamined Patent Application Publication (JP-A) No. 2006-59788. The connector includes a fitting portion which is movable in a connecting/disconnecting direction. The fitting portion is fixed until the connector is completely fitted to a mating object. After the connector is completely fitted to the mating object, the fitting portion is allowed to be moved in the connecting/disconnecting direction.

In the above-mentioned connector, however, if the fitting portion is excessively moved in the state where the connector is fitted to the mating object, a contact of the connector may excessively be deformed to cause plastic deformation.

On the other hand, Japanese Unexamined Patent Application Publication (JP-A) No. H10-326654 discloses a connector comprising a first housing mounted on a printed board, a second housing separated from the first housing, and a plurality of flexible contacts held between the first and the second housings. In this connector, the second housing is movable with respect to the first housing because of flexibility of the flexible contacts.

However, this connector is similarly disadvantageous in that, if the second housing is excessively moved with respect to the first housing, flexible contacts may excessively be deformed to cause plastic deformation.

SUMMARY

Accordingly, in each of the above-mentioned connectors, sufficient attention must be given in performing a connecting operation. Thus, room for improvement is still left in operability of connection and in reliability of connection.

It is therefore an exemplary object of this invention to provide a floating-type connector excellent in operability of connection and high in reliability.

Other objects of the present invention will become clear as the description proceeds.

According to an exemplary aspect of the present invention, there is provided a connector adapted to be connected to and disconnected from a mating object in a connecting/disconnecting direction, the connector comprising an alignment member, a rear housing that is coupled to the alignment member, a front housing that is adapted to receive the mating object and is movable with respect to the alignment member and the rear housing, and a contact that is held by the front housing and the rear housing, wherein the alignment member and the rear housing include a stopper mechanism which three-dimensionally defines a movable range of the front housing.

DESCRIPTION OF THE EXEMPLARY EMBODIMENT

Figure 1:
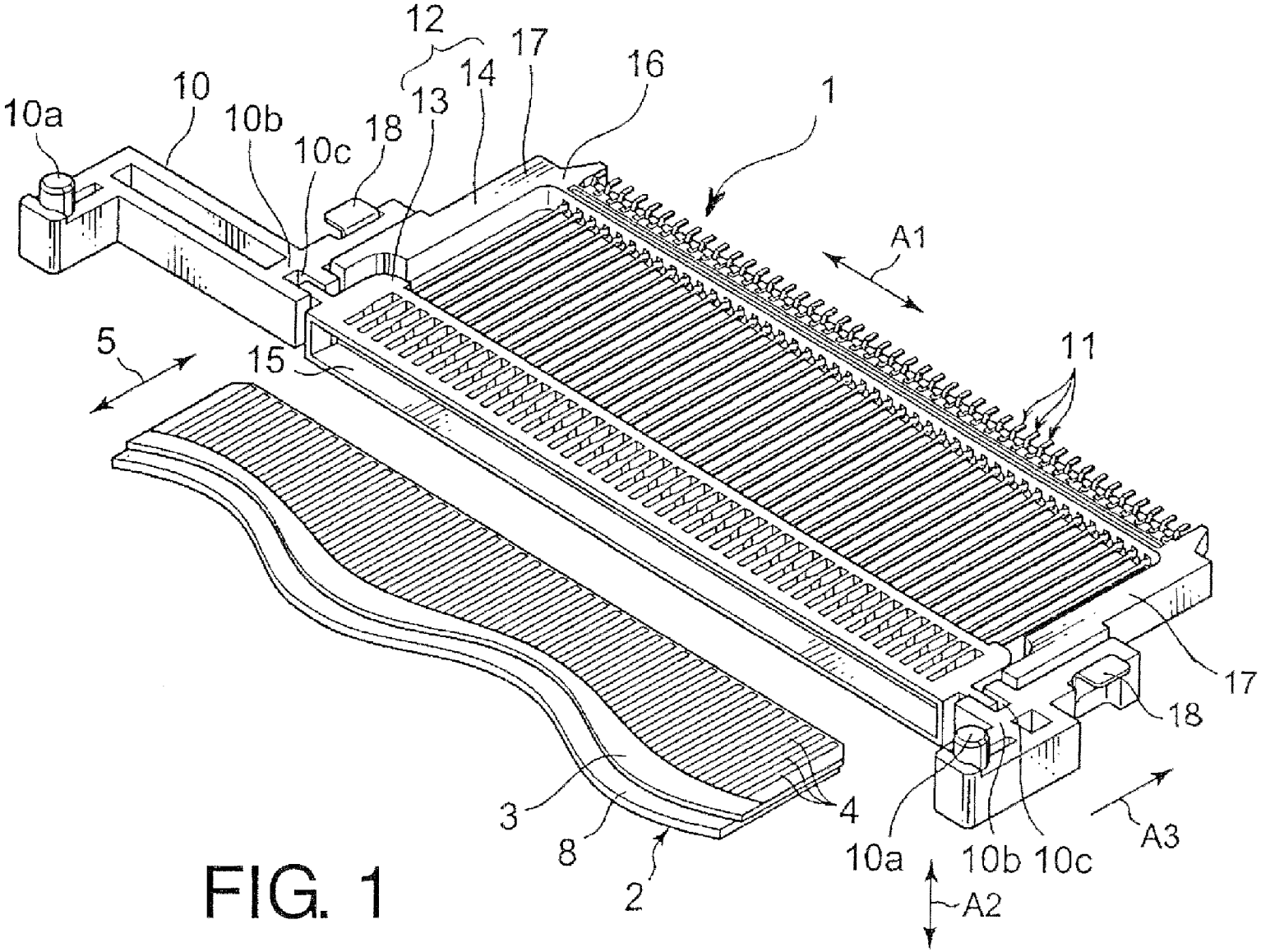
FIG. 1 is a perspective view of a connector according to an exemplary embodiment of this invention, together with a mating object.
Figure 2:
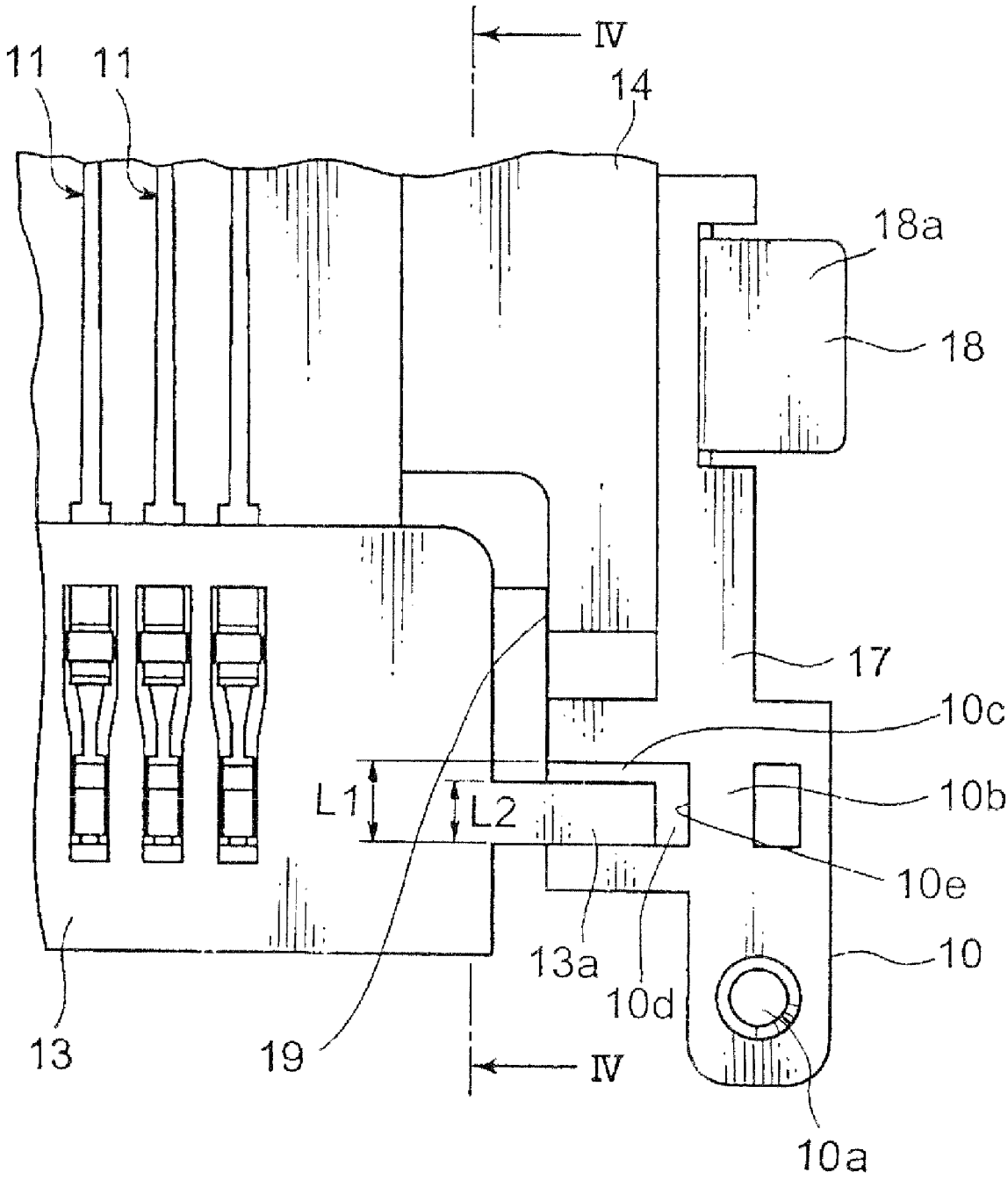
FIG. 2 is a plan view of a part of the connector illustrated in FIG. 1.
Figure 3:
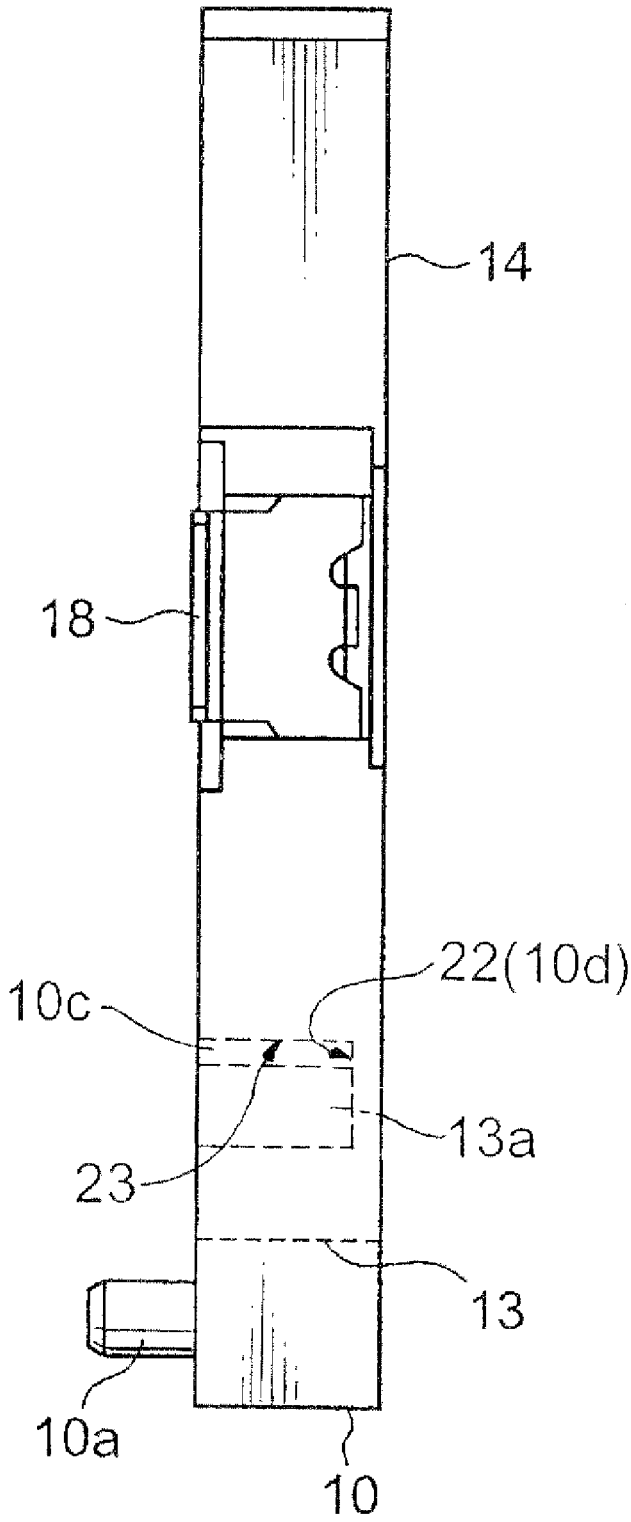
FIG. 3 is a side view of a part of the connector illustrated in FIG. 1.
Figure 4:
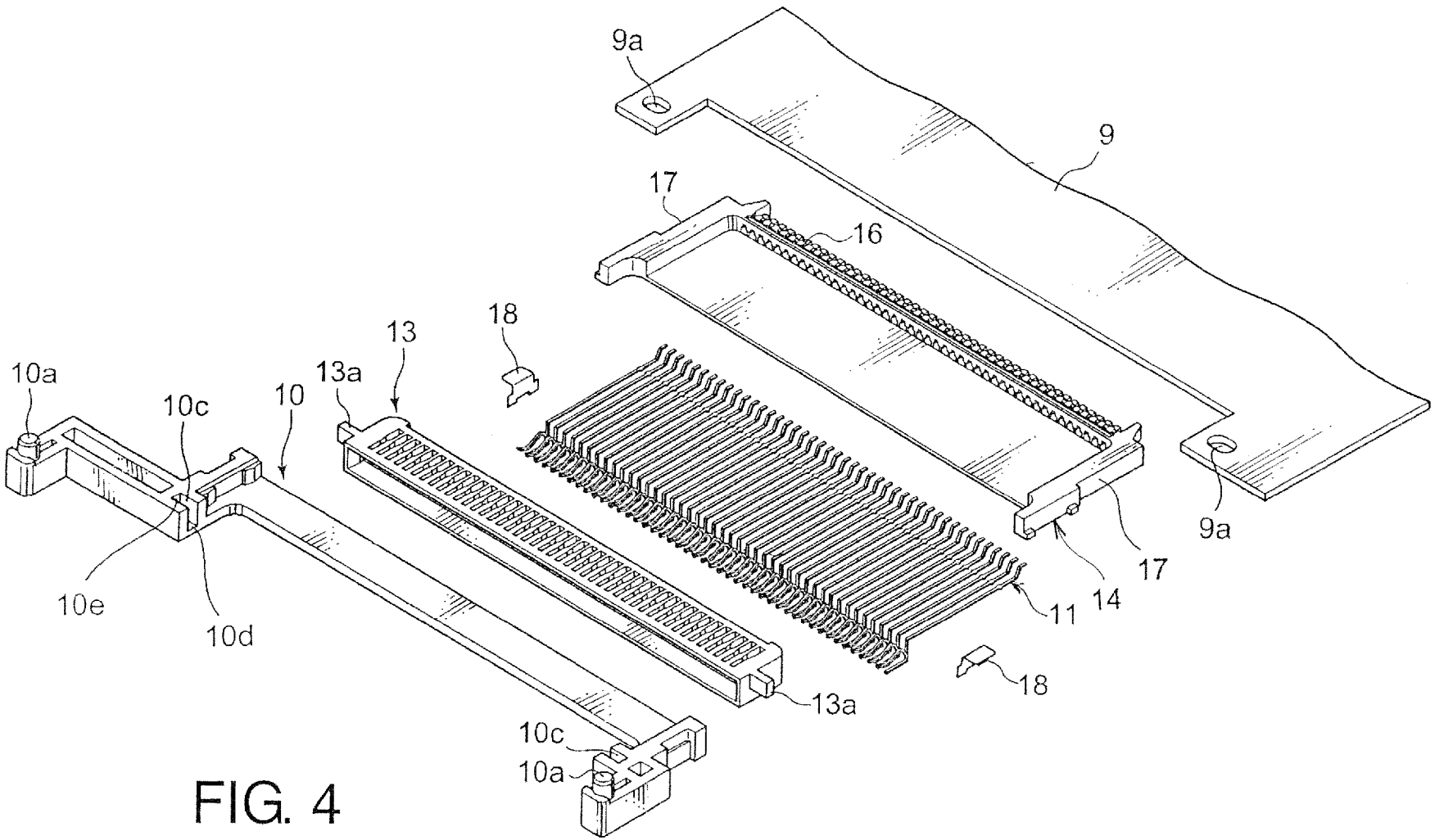
FIG. 4 is an exploded perspective view of the connector illustrated in FIG. 1, together with a mounting object adapted to mount the connector.

Referring to FIGS. 1 to 6, description will be made of a connector according to an exemplary embodiment of this invention.

A connector 1 illustrated in the figure is adapted to be fitted and connected to an edge portion of a card 2 as an example of a mating object and is therefore called a card edge connector 1.

The card 2 comprises an insulating card substrate 3 and a number of conductive contact points 4 formed on one surface of the card substrate 3 and arranged in parallel to one another along one edge thereof. The card 2 is adapted to be fitted to or removed from the card edge connector 1 with the movement in a fitting/removing direction (connecting/disconnecting direction) 5. The card substrate 3 has the other surface opposite to the one surface and provided with a metal reinforcing plate 8.

The card edge connector 1 includes an alignment member 10 for positioning the connector 1 with respect to a printed board 9 or the like as a mounting object of the connector 1, a number of conductive contacts of an elongated shape having elasticity and flexibility, and a housing 12 holding the contacts 11.

The alignment member 10 has a pair of positioning bosses 10*a* to be inserted into holes 9*a* formed on the printed board 9 to position the connector 1. Further, the alignment member 10 has a pair of hold-downs 18. Each of the hold-downs 18 has a soldering portion 18*a*. By soldering the soldering portions 18*a* of the hold-downs 18 to pads (not shown) of the printed board 9, the card edge connector 1 is fixed to the substrate 9. The housing 12 includes an insulating first housing (front housing) 13 and an insulating second housing (rear housing) 14 separated from the first housing 13.

The first housing 13 extends long in a first direction A1 perpendicular to the fitting/removing direction 5. The first housing 13 has a fitting hole 15 formed on an outward-facing surface (front surface) in the fitting/removing direction 5 and extending long in the first direction A1 to receive an edge portion of the card 2. The first housing 13 has a pair of protruding portions 13*a* formed at longitudinal opposite ends thereof. The protruding portions 13*a* are inserted into grooves 10*c* formed on stopper portions 10*b* of the alignment member 10, respectively. The grooves 10*c* are designed to be greater than the protruding portions 13*a* in dimension in the fitting/removing direction 5. Therefore, the first housing 13 is movable with respect to the alignment member 10 in the fitting/removing direction 5 within a range defined by the stopper portions 10*b*. It is noted here that the grooves 10*c* have closed bottoms.

The second housing 14 has a main portion 16 extending in parallel to the first housing 13, and a pair of side portions 17 perpendicularly bent from opposite ends of the main portion 16, respectively, and extending frontward. The side portions 17 allow the first housing 13 to be three-dimensionally movable. Specifically, the first housing 13 is movable with respect to the second housing 14 in the fitting/removing direction 5, the first direction A1, and a second direction A2 perpendicular to the fitting/removing direction 5 and the first direction A1.

The alignment member 10 and the second housing 14 have a stopper mechanism which three-dimensionally defines a movable range of the first housing 13. In addition to the above-mentioned stopper portions 10*b* for inhibiting or limiting the movement of the first housing 13 in the fitting/removing direction 5, the stopper mechanism includes a leftward/rightward stopper 19, an upward stopper 22, the board 9 as a downward stopper, and a rearward stopper 23. The leftward/rightward stopper 19 serves as a first stopper for inhibiting the movement of the first housing 13 in the first direction A1. A combination of the upward stopper 22 and the board 9 as the downward stopper serves as a second stopper for inhibiting the movement of the first housing 13 in the second direction A2. The rearward stopper 23 serves as a third stopper for inhibiting the movement of the first housing 13 in a third direction A3, as one direction in the fitting/removing direction 5, along which a pressing force of the card 2 is exerted. Each of the grooves 10*c* having the closed bottoms may be arranged so that a bottom portion 10*d* of the groove 10*c* serves as an upward stopper while side walls 10*e* of the groove 10*c* serve as a leftward/rightward stopper.

On the other hand, each contact 11 has an integral structure including a contacting portion 26 to be contacted with the card 2, a terminal portion 27 formed on the side opposite to the contacting portion 26, and a connecting portion 29 connecting the contacting portion 26 and the terminal portion 27. The contacting portion 26 has a part disposed in the fitting hole 15 and adapted to be contacted with the contact points 4 of the card 2 when the card 2 is inserted into the fitting hole 15. The terminal portion 27 has a part exposed rearward from the second housing 14 and is adapted to be connected by soldering to a connection object, such as a circuit board.

The first housing 13 holds the contacts 11 in the vicinity of the contacting portions 26. The second housing 14 holds the contacts 11 in the vicinity of the terminal portions 27. Thus, the connecting portions 29 allows the first housing 13 to be three-dimensionally movable with respect to the second housing 14 with bending of the connecting portion 29.

Figure 5:
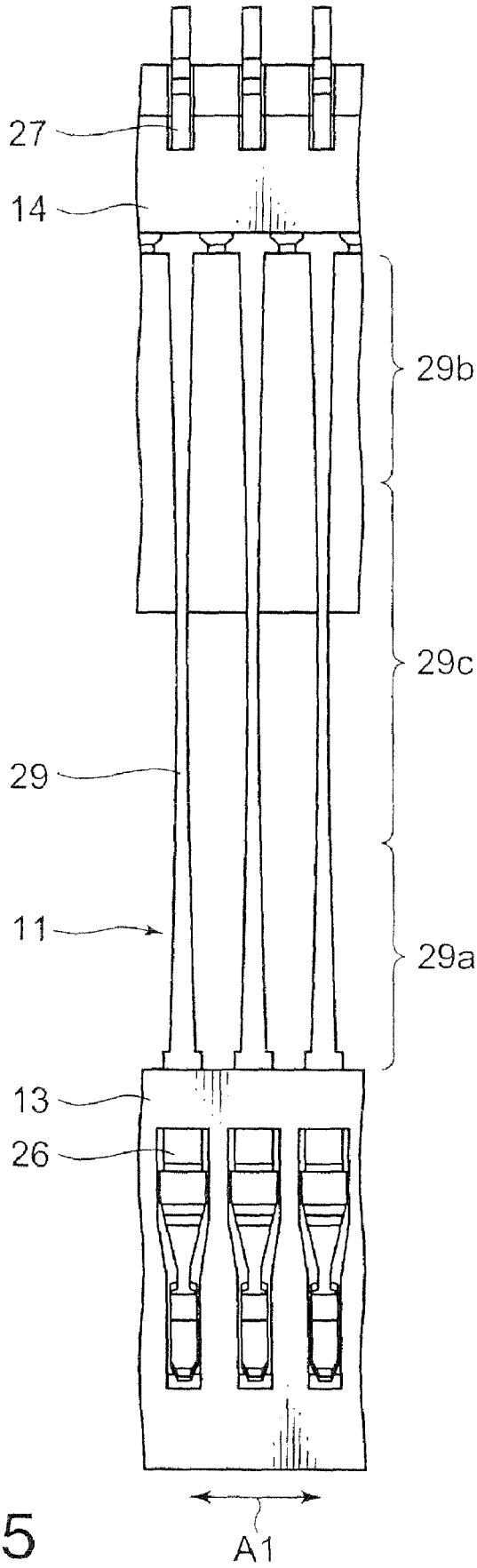
FIG. 5 is a partial enlarged plan view for describing a specific part of the connector illustrated in FIG. 1.

As is obvious from FIG. 5, the connecting portion 29 of each contact 11 has a first portion 29*a* near the contacting portion 26, a second portion 29*b* near the terminal portion 27, and an intermediate portion 29*c* between the first and the second portions 29*a* and 29*b*. As seen from the figure, the intermediate portion 29*c* is narrower in width than the first and the second portions 29*a* and 29*b*. In other words, the connecting portion 29 is gradually narrower in width from each of the first and the second portions 29*a* and 29*b* towards the intermediate portion 29*c*. Specifically, each of the first and the second portions 29*a* and 29*b* has a tapered shape narrowed in width towards the intermediate portion 29*c*. Each of the first and the second portions 29*a* and 29*b* is defined in width by opposite sides which may be rectilinear or curved.

When the card 2 is inserted into the fitting hole 15 of the above-mentioned card edge connector 1, the card 2 is electrically connected to the card edge connector 1 even if the first housing 13 is three-dimensionally moved as necessary. At this time, the movable range of the first housing 13 is three-dimensionally determined by the stopper mechanism so that excessive deformation of the contacts 11 is suppressed. In addition, the contacts 11 have such a special shape so that internal stress is distributed. Accordingly, the possibility of plastic deformation of the contacts 11 is reduced.

Figure 6:
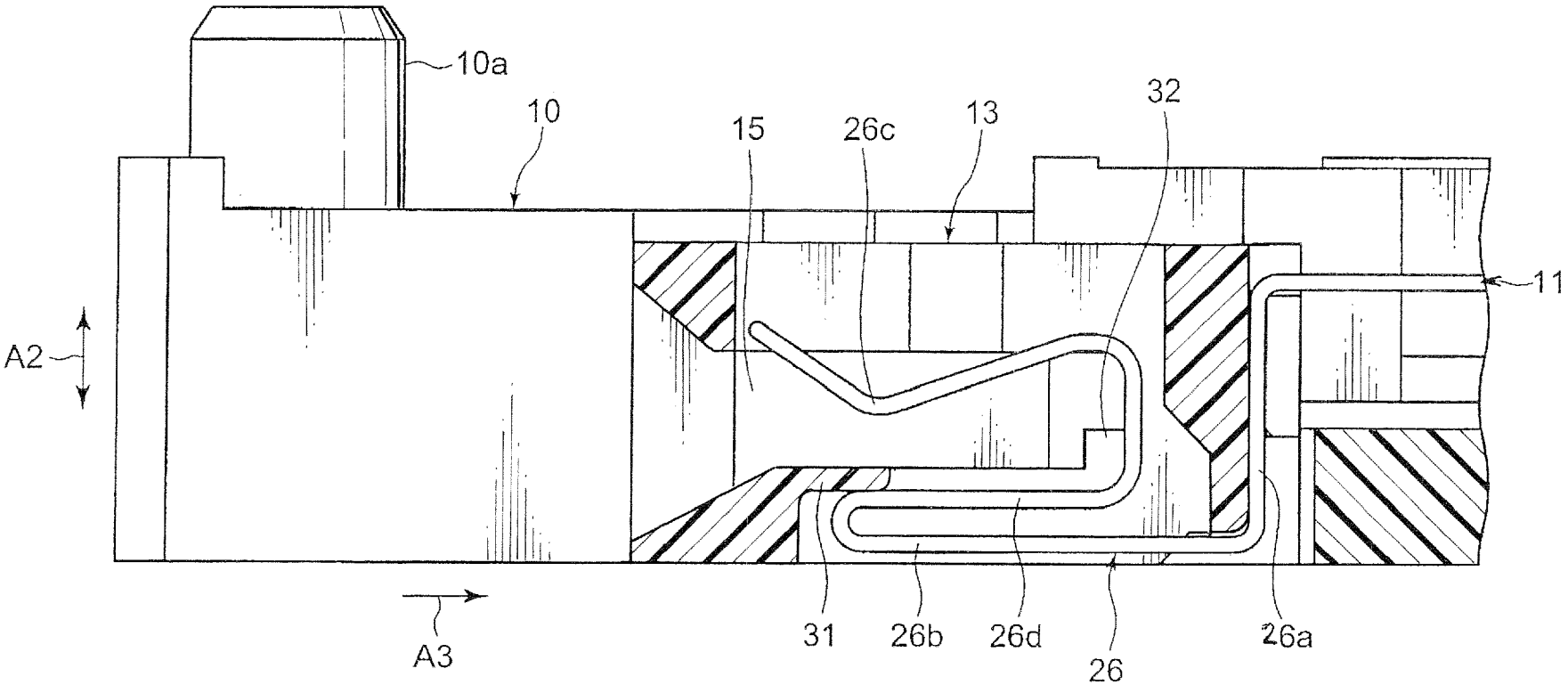
FIG. 6 is an enlarged sectional side view of a part of the connector illustrated in FIG. 1.

Next, referring to FIG. 6, description will be made of the structure of the contacts 11 in the first housing 13. The contacting portion 26 of each contact 11 has a holding portion 26*a* fixedly held by the first housing 13, a U-shaped spring portion 26*b* extending from the holding portion 26*a*, and a contact point portion 26*c* formed at a part extending from the spring portion 26*b*. The spring portion 26*b* has a turn-around portion 26*d* in the vicinity of the fitting hole 15 of the first housing 13.

When the card 2 is inserted into the fitting hole 15, the contact points 4 of the card 2 are contacted with the contact point portions 26*c* of the contacts 11. At this time, in order to prevent the reinforcing plate 8 of the card 2 from being brought into contact with the turn-around portions 26*d* of the contacts 11, the first housing 13 is provided with an insulator 31 formed at a position adjacent to the fitting hole 15. As a result, the card 2 is sandwiched between the contact point portions 26*c* of the contacts 11 and the insulator 31, so that a part of the insulator 31 is reinforced by the reinforcing plate 8 of the card 2. As a result, the reinforcing plate 8 is not contacted with the turn-around portions 26*d* of the contacts 11 but only the contact points 4 are contacted with the contact point portions 26*c* of the contacts 11.

If the card 2 is butted against the contacts 11 in the third direction A3 when the card 2 is inserted into the fitting hole 15, electrical short-circuiting may be caused to occur. In order to prevent such electrical short-circuiting, the first housing 13 is provided with a protrusion 32 formed at an inner portion of the fitting hole 15. As a result, even if the card 2 is inserted deep into the fitting hole 15, the card 2 is butted against the protrusion 32. Therefore, electrical short-circuiting is prevented.

In the exemplary embodiment described above, the width (L2) of the protruding portion 13*a* is narrower than the width (L1) of the groove 10*c* so that the first housing 13 is movable in the fitting/removing direction 5 (FIG. 1). However, if floating in the fitting direction (third direction A3) is unnecessary, the alignment member 10 may be used for positioning of the first housing 13. In this case, the width (L1) of the groove 10*c* and the width (L2) of the protruding portion 13*a* are designed to be substantially equal to each other. With this structure, the alignment member 10 positions the first housing 13 in the fitting/removing direction 5 and inhibits the movement in the third direction A3 (see FIG. 1).

Various exemplary embodiments of this invention will be enumerated in the following items 1-12.

1. A connector 1 adapted to be connected to and disconnected from a mating object 2 in a connecting/disconnecting direction 5, the connector 1 comprising:

an alignment member 10;

a rear housing 13 that is coupled to the alignment member 10;

a front housing 14 that is adapted to receive the mating object 2 and is movable with respect to the alignment member 10 and the rear housing 14; and a contact 11 that is held by the front housing 13 and the rear housing 14;

wherein the alignment member 10 and the rear housing 14 include a stopper mechanism which three-dimensionally defines a movable range of the front housing 13.

2. The connector according to item 1, wherein the front housing 13 is three-dimensionally movable with respect to the rear housing 14, and the stopper mechanism includes a stopper portion 10*b* which is formed on the alignment member 10 to inhibit the movement of the front housing 14 in the connecting/disconnecting direction 5.

3. The connector according to item 2, wherein the contact 11 comprises:

a contacting portion 26 that is adapted to be contacted with the mating object 2;

a terminal portion 27 that is opposite to the contacting portion 26; and a connecting portion 29 that is connected between the contacting portion 26 and the terminal portion 27, wherein the front housing 13 holds the contact 11 in the vicinity of the contacting portion 26, the rear housing 14 holds the contact 11 in the vicinity of the terminal portion 27, and the front housing 13 is allowed to perform three-dimensional movement with respect to the rear housing 14 with bending of the connecting portion 29.

4. The connector according to item 3, wherein the connecting portion 29 comprises:

a first portion 29*a* that is near the contacting portion 26;

a second portion 29*b* that is near the terminal portion 27; and an intermediate portion 29*c* that is formed between the first and the second portions 29*a* and 29*b* and is narrower in width than the first and the second portions 29*a* and 29*b*.

5. The connector according to item 3, wherein the connecting portion 29 comprises:

a first portion 29*a* that is near the contacting portion 26;

a second portion 29*b* that is near the terminal portion 27; and an intermediate portion 29*c* that is formed between the first and the second portions 29*a* and 29*b*, wherein the connecting portion 29 is gradually narrower in width from each of the first and the second portions 29*a* and 29*b* towards the intermediate portion 29*c*.

6. The connector according to item 1, wherein the stopper mechanism comprises:

a first stopper that is for inhibiting the movement of the front housing 13 in a first direction A1 which is perpendicular to the connecting/disconnecting direction 5; and a second stopper that is for inhibiting the movement of the front housing 13 in a second direction A2 which is perpendicular to the connecting/disconnecting direction 5 and the first direction A1

7. The connector according to item 6, wherein the first stopper is formed on at least one of the rear housing 14 and the alignment member 10.

8. The connector according to item 6, wherein the stopper is formed on at least one of the rear housing 14 and the alignment member 10.

9. The connector according to item 6, wherein the stopper mechanism further comprises a third stopper that is for inhibiting the movement of the front housing 13 in a third direction A3 as one direction of the connecting/disconnecting direction 5, along which a pressing force of the mating object 2 is exerted.

10. The connector according to item 9, wherein the third stopper is formed on the alignment member 10.

While the invention has been particularly shown and described with reference to the exemplary embodiment thereof, the invention is not limited to the foregoing embodiment. It will be understood by those of ordinary skill in the art that various changes in form and details may be made therein without departing from the spirit and scope of the present invention as defined by the claims.

What is claimed is:

1. A connector adapted to be connected to and disconnected from a mating object in a connecting/disconnecting direction, the connector comprising:

an alignment member;

a rear housing that is coupled to the alignment member;

a front housing that is adapted to receive the mating object; and a contact that is held by the front housing and the rear housing;

wherein the alignment member, the rear housing, and the front housing are made as separate parts that are separate from each other;

wherein the front housing is three-dimensionally movable with respect to the alignment member and the rear housing;

wherein the alignment member and the rear housing include a stopper mechanism which three-dimensionally defines a movable range of the front housing; and wherein the stopper mechanism includes a stopper portion which is formed on the alignment member to inhibit movement of the front housing in the connecting/disconnecting direction.

2. The connector according to claim 1, wherein the stopper mechanism comprises:

a first stopper for inhibiting movement of the front housing in a first direction which is perpendicular to the connecting/disconnecting direction; and a second stopper for inhibiting movement of the front housing in a second direction which is perpendicular to the connecting/disconnecting direction and the first direction.

3. The connector according to claim 1, wherein the contact comprises:

a contacting portion that is adapted to be contacted with the mating object;

a terminal portion that is opposite to the contacting portion; and a connecting portion that is connected between the contacting portion and the terminal portion, wherein the front housing holds the contact in a vicinity of the contacting portion, the rear housing holds the contact in a vicinity of the terminal portion, and the front housing is allowed to perform three-dimensional movement with respect to the rear housing by bending of the connecting portion.

4. The connector according to claim 3, wherein the connecting portion comprises:

a first portion that is near the contacting portion;

a second portion that is near the terminal portion; and an intermediate portion that is formed between the first and the second portions and is narrower in width than the first and the second portions.

5. The connector according to claim 3, wherein the connecting portion comprises:

a first portion that is near the contacting portion;

a second portion that is near the terminal portion; and an intermediate portion that is formed between the first and the second portions, wherein the connecting portion gradually narrows in width from each of the first and the second portions towards the intermediate portion.

6. The connector according to claim 2, wherein the stopper mechanism further comprises a third stopper for inhibiting movement of the front housing in a third direction, which is a direction along the connecting/disconnecting direction along which a pressing force of the mating object is exerted.

7. The connector according to claim 2, wherein the first stopper is formed on at least one of the rear housing and the alignment member.

8. The connector according to claim 2, wherein the second stopper is formed on at least one of the rear housing and the alignment member.

9. The connector according to claim 6, wherein the third stopper is formed on the alignment member.

* * * * *